US006478486B1

(12) United States Patent
Ando

(10) Patent No.: US 6,478,486 B1
(45) Date of Patent: Nov. 12, 2002

(54) PRINTER WITH RIBBON ADVANCE MECHANISM

(75) Inventor: Mitsuhisa Ando, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 30 days.

(21) Appl. No.: 09/650,145

(22) Filed: Aug. 29, 2000

Related U.S. Application Data

(63) Continuation of application No. PCT/JP99/07383, filed on Dec. 28, 1999.

(51) Int. Cl.[7] ..... B41J 11/26

(52) U.S. Cl. ..... 400/236.2; 400/223; 400/229; 400/231

(58) Field of Search ..... 400/223, 225, 400/224, 231, 232, 233, 229, 236, 236.2

(56) References Cited

U.S. PATENT DOCUMENTS

| | | | | | |
|---|---|---|---|---|---|
| 4,342,520 | A | * | 8/1982 | Isobe et al. | 400/221 |
| 4,609,299 | A | * | 9/1986 | Hattori et al. | 400/229 |
| 4,908,632 | A | * | 3/1990 | Ishikawa et al. | 346/139 R |
| 4,952,086 | A | * | 8/1990 | Yamaguchi | 400/208 |
| 5,893,669 | A | * | 4/1999 | Sugai et al. | 400/223 |
| 6,019,529 | A | * | 2/2000 | Yamamoto et al. | 400/231 |
| 6,394,675 | B1 | * | 5/2002 | Sodeyama et al. | 400/208 |

FOREIGN PATENT DOCUMENTS

| | | |
|---|---|---|
| JP | 60-58363 | 4/1985 |
| JP | 60-131285 | 7/1985 |
| JP | 61-28659 | 2/1986 |
| JP | 62-200466 | 12/1987 |
| JP | 63-78784 | 4/1988 |
| JP | 63-109079 | 5/1988 |
| JP | 63-231966 | 9/1988 |
| JP | 2-133363 | 11/1990 |
| JP | 3-173674 | 7/1991 |
| JP | 7-10612 | 2/1995 |
| JP | 8-25768 | 1/1996 |
| JP | 9-277675 | 10/1997 |
| JP | 11-1040 | 1/1999 |

* cited by examiner

*Primary Examiner*—Andrew H. Hirshfeld
*Assistant Examiner*—Kevin D. Williams
(74) *Attorney, Agent, or Firm*—Nixon & Vanderhye P.C.

(57) ABSTRACT

A ribbon advance mechanism has a advancing spool, a metal support shaft for supporting a advancing spool base part for rotation, and a coil spring attached between a base part of the advancing spool and the support shaft. The coil spring is mounted on a center part of the support shaft in a state in which it is slightly spread. One end part of a hook of the coil spring is fixed to a slit of the advancing spool base part, whereby the advancing spool is allowed to rotate only in an advancing direction (R direction), and when power is not transferred to the advancing spool, an ink ribbon is not slack. The coil spring is placed in a enclosed space by the base part of the advancing spool and a base part of the support shaft.

17 Claims, 7 Drawing Sheets

PRINTER WITH RIBBON ADVANCE MECHANISM

CROSS REFERENCE TO RELATED APPLICATIONS

This is a continuation of PCT application PCT/JP99/07383 filed Dec. 28, 1999 and designating the United States of America, and also claims the priority of Japanese patent application Hei. 11-001987 filed Jan. 7, 1999. The disclosures of these applications are incorporated herein by reference.

BACKGROUND OF THE INVENTION

This invention relates to improvements in advance mechanisms for advancing a ribbon in a printer, such as an ink ribbon in a dot-impact serial printer.

Generally, in a printer using an ink ribbon, a print head for printing on recording paper and the like often operates reciprocally and a mechanism is used for winding an ink ribbon in a ribbon cassette in one direction, using only a unidirectional driving force of. the driving force of the reciprocating print head.

The winding mechanism shown in FIG. 8 has been known. The winding mechanism comprises an arm 115 in contact with a gear 111 which converts the reciprocating operation of a print head into rotational motion. The arm 115 follows the gear 111 by friction. An idler gear 112, which engages with the gear 111, moves with the arm rotation.

When the print head is moved in one direction and the gear 111 is rotated clockwise, the arm 115 is also rotated following the gear, causing the idler gear 112 and the gear 114 to engage with each other, and thereby to drive a gear 113 coupled directly to a ribbon winding spool. Conversely, when the print head is moved in an opposite direction and the gear 111 is rotated counterclockwise, the arm 115 also is rotated following the gear, causing the idler gear 112 and the gear 114 to be disengaged.

However, the winding mechanism of FIG. 8 has the following problems: When the idler gear 112 and the gear 114 are placed out of engagement, namely, when the print head is moved in the direction in which an ink ribbon is not fed, the tension given to the ink ribbon is reduced and the ink ribbon becomes slack. If the movement direction of the print head is changed and the gear 113 coupled directly to the ribbon winding spool is driven, tension is again applied to the slack ink ribbon, but the ink ribbon is not advanced until it becomes tight following the initial stage of moving the print head. Therefore, the print head must make an extra movement until the ink ribbon is wound after the movement direction of the print head is changed, causing the print time of the print head to be prolonged as much as that time interval.

If the print head is moved with the ink ribbon slack, recording paper and the like can become dirty or the print head catches the ink ribbon. This is also a problem.

The invention is intended for solving such technical problems of the prior art. It is an object of the invention to provide a printer comprising an advance mechanism for advancing a ribbon while preventing the ribbon from becoming slack when a driving force is not applied.

It is another object of the invention to provide a printer for reducing the likelihood that recording paper and the like will become dirty or that the ribbon will be caught.

BRIEF SUMMARY OF THE INVENTION

In one embodiment of the invention, a printer is provided comprising a dot-impact head for striking an ink ribbon for printing on recording paper, a carriage mounting the dot-impact head thereon, a motor, a carriage drive mechanism connected to the motor for reciprocating the carriage by turning the motor forward and in reverse, an advance mechanism or winding spool for advancing the ink ribbon in one direction, and a transfer mechanism connected to the carriage drive mechanism. The transfer mechanism transfers a driving force of the motor to the advance mechanism when the carriage is moved in a first direction and releases the driving force of the motor from the advance mechanism when the carriage is moved in a second direction opposite to the first direction.

The advance mechanism of this embodiment comprises a support shaft, a winding member rotatably supported on the support shaft and rotation limiter. The winding member winds the ink ribbon by rotating in a third direction. The rotation limiter is provided in the winding member, allows the winding member to rotate in the third direction and inhibits the winding member from rotating in a fourth direction opposite to the third direction.

The winding member is limited by the rotation limiter so as to rotate only in the ink ribbon winding direction, so that if a force acts on the winding member, which would loosen the ink ribbon in a state in which a driving force is not transferred to the winding member, the winding member is limited in rotation by the rotation limiter and does not rotate in the opposite direction to the winding direction (fourth direction), thus the ink ribbon does not become slack.

Consequently, when transfering a driving force to the winding member intermittently for winding the ink ribbon, winding of the ink ribbon can always be started at the state in which the ink ribbon is tight. That is, if the print head moves in the direction not winding the ink ribbon or a driving force is not transferred to the advance mechanism, the ink ribbon is always held in a state in which it is tight. Thus, when winding the ink ribbon is again started, it is possible to reduce the time required for making the transition of the ink ribbon from the loose state to the tensioned state and to reduce the movement distance of the print head. Since the ink ribbon is not slack, smudging of recording paper and the like caused by contact with the ink ribbon and catching the print head in the ink ribbon can be prevented.

In this invention, the concept of "advancing" includes not only the generally assumed meaning of winding around a winding shaft, but also the meaning of circulating, for example, by feeding in one constant direction. More particularly, an embodiment of the mechanism can be configured as follows:

The transfer mechanism comprises a first gear connected to the carriage drive mechanism, a first gear shaft rotatably supporting the first gear, a lever pivotally supported on the first gear shaft and having an arc-shaped guide groove centered on the first gear shaft, a second gear connected to the advance mechanism, a second gear shaft rotatably supporting the second gear and engaging the guide groove for guiding the pivotal movement of the lever, a third gear shaft provided on the lever, and a third gear rotatably attached to the third gear shaft and engageable with the second gear. In this case, the lever may be adapted to move in a direction in which the third gear engages with the second gear when the carriage is moved in the first direction, and move in a direction in which the third gear disengages from the second gear when the carriage is moved in the second direction.

A rotation limiter can be used which comprises a first coil spring wound around the support shaft having one end part fixed to the winding member. In this case, the first coil spring is deformably attached to the support shaft so that the first coil spring tightens on the support shaft when the winding member is rotated in the fourth direction, and is loosened from the support shaft when the winding member is rotated in the third direction.

Accordingly, if the winding member is rotated in the opposite direction to the winding direction (fourth direction) with respect to the support shaft, the torsion spring (first coil spring) tightens on the support shaft, therefore rotation of the winding member in the opposite direction to the winding direction can be easily suppressed. Generally, the torsion spring has excellent durability concerning wear proof and is inexpensive, therefore an advance mechanism excellent in durability and cost efficiency can be provided. Since the torsion spring is accommodated in the winding member, it is shut off from external dust, and the like. Therefore, dust, and the like, can be prevented from entering the clearance between the torsion spring and the coil spring, avoiding wear of the torsion spring or the support shaft, and an advance mechanism having higher durability can be provided.

When a ribbon cassette containing an ink ribbon is mounted on the printer, a hole in the bottom of the ribbon winding roller on the ribbon cassette side engages a connection part formed at the tip of the winding member on the printer side, whereby the ink ribbon in the ribbon cassette is transported. The hole made in the bottom of the winding roller can be formed in its inner periphery with a spline (key groove). The winding member also can be formed on the outer periphery of the tip (connection part) with a spline corresponding to the spline made in the inner periphery of the hole.

In an embodiment of the invention, the tip of the winding member (connection part) can be configured as follows: The winding member comprises a fourth gear connected to the transfer mechanism, a base part comprising a bearing for receiving the support shaft, and a connection part attached to the base part so that it can be moved in a direction parallel to the support shaft. In this case, a second coil spring for urging the connection part in a direction away from the base part is placed in the base part. Further, an annular groove for fixing one end of the second coil spring may be formed in the outer section of the bearing. Thus, the connection part connected to the ribbon cassette is attached to the base part of the winding member so that it can be moved up and down, and is urged upward by the coil spring, so that when the ribbon cassette is mounted, if the splines of the hole and the connection part do not match, the connection part is moved to the base part side. Then, when the winding member is driven and both spline positions match, the connection part is pushed by the second coil spring and engages the hole on the ribbon cassette side. Such a configuration makes it possible to prevent the tip of the winding member from becoming broken. The annular groove for fixing one end of the second coil spring is formed in the outer part of the bearing, the first coil spring-which is the rotation limiter-is located below the bearing, and the second coil is located above the bearing, so that the advance mechanism can be miniaturized.

DETAILED DESCRIPTION OF THE INVENTION

An embodiment of an advance mechanism and a printer using the advance mechanism according to the invention will be discussed in detail with reference to the accompanying drawings.

Figure 1:
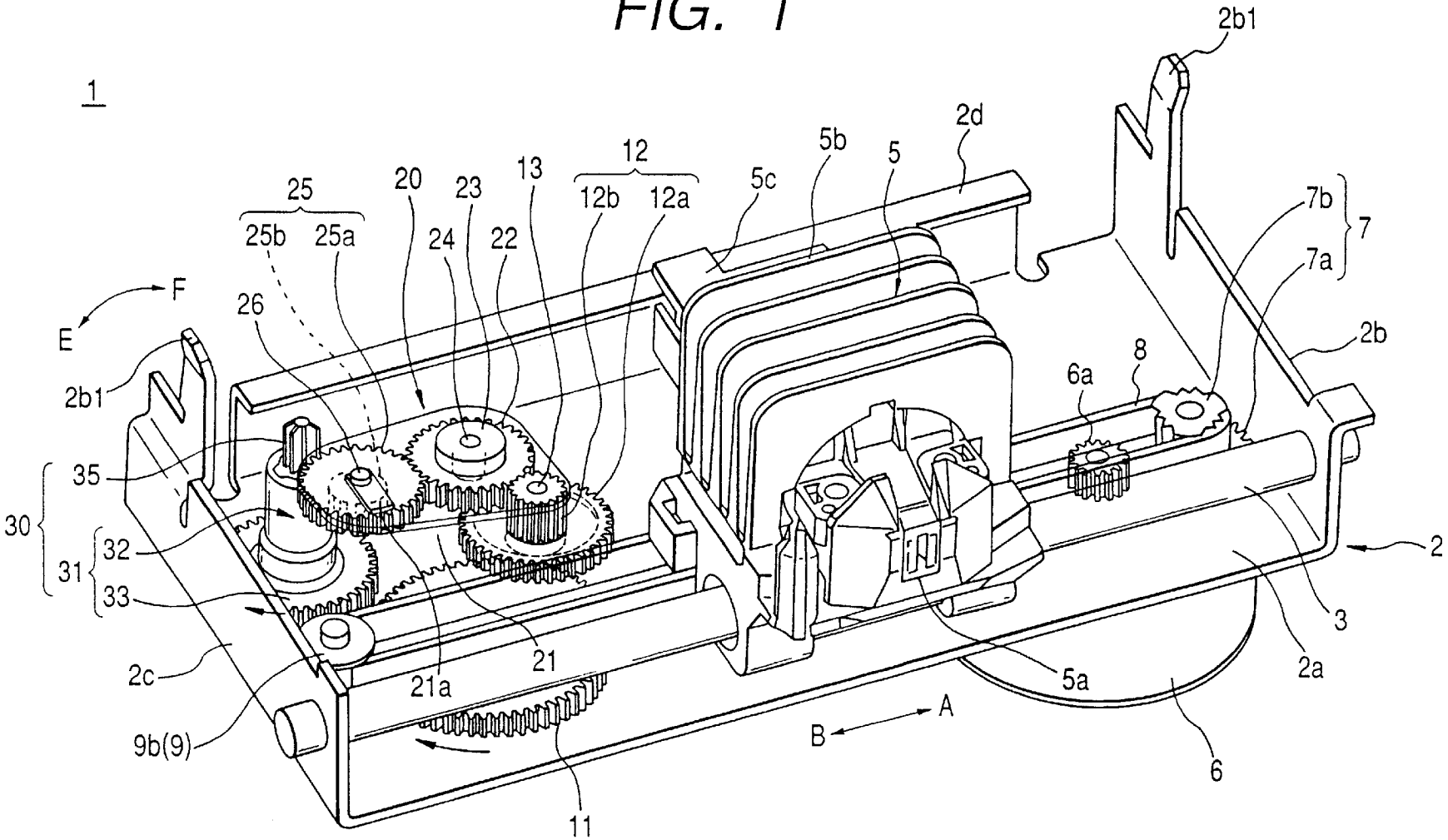
FIG. 1 is a perspective view showing a schematic configuration of the main part of a printer of one embodiment of the invention.
Figure 2:
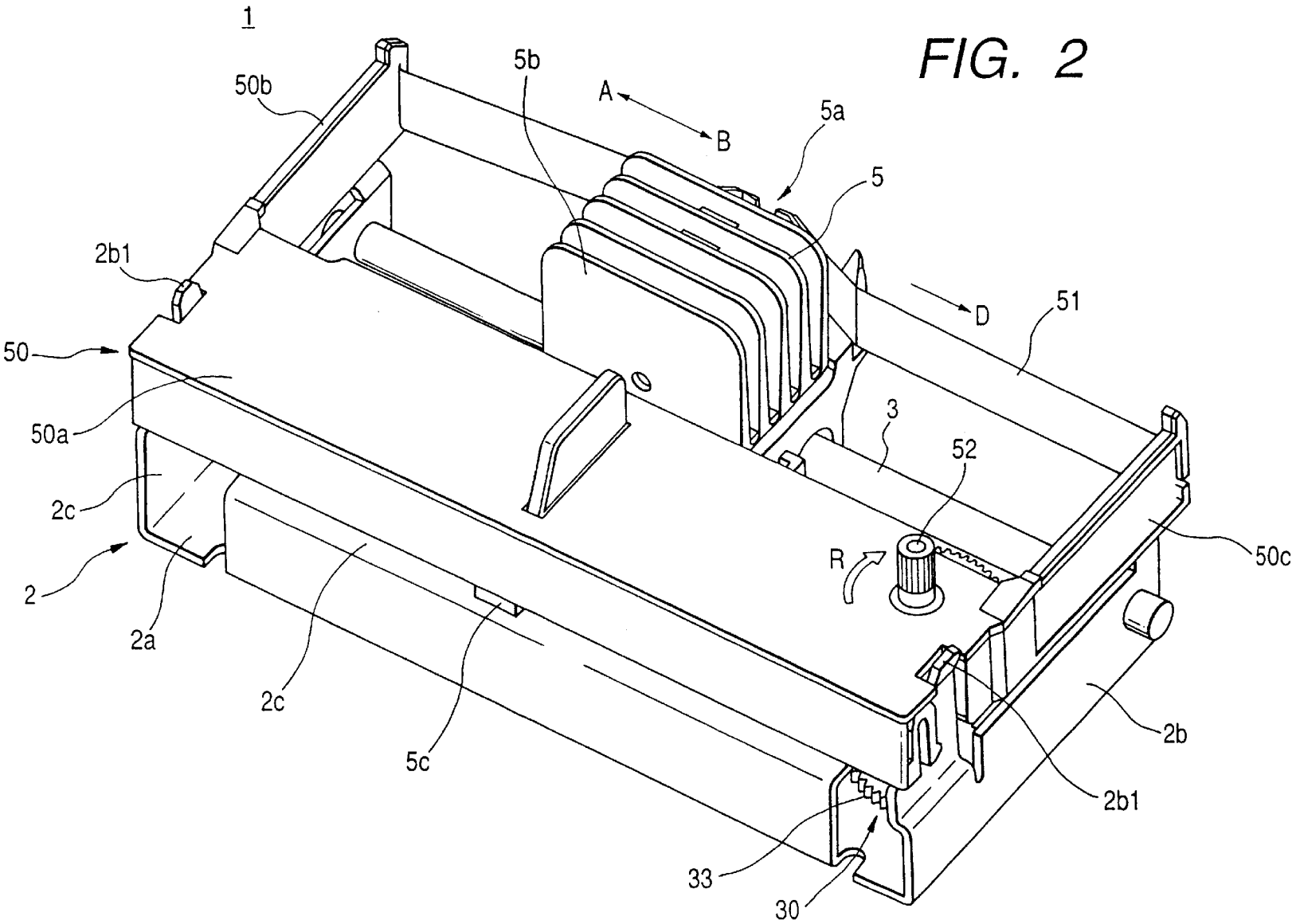
FIG. 2 is a perspective view showing the printer with a ribbon cassette mounted on the printer of the embodiment of the invention.
Figure 7:
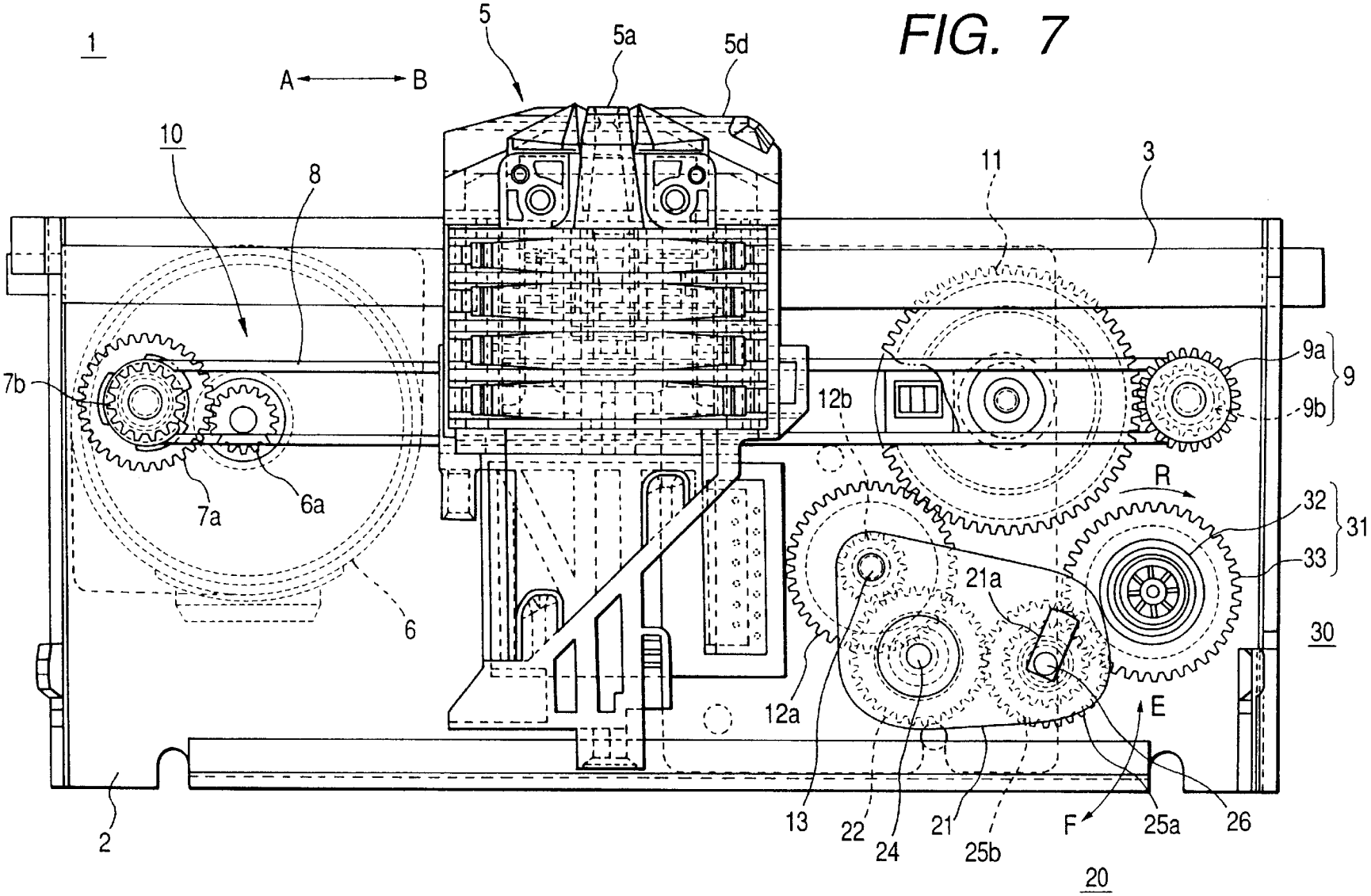
FIG. 7 is a plan view showing a schematic configuration of the main part of the printer shown in FIG. 1.
Figure 8:
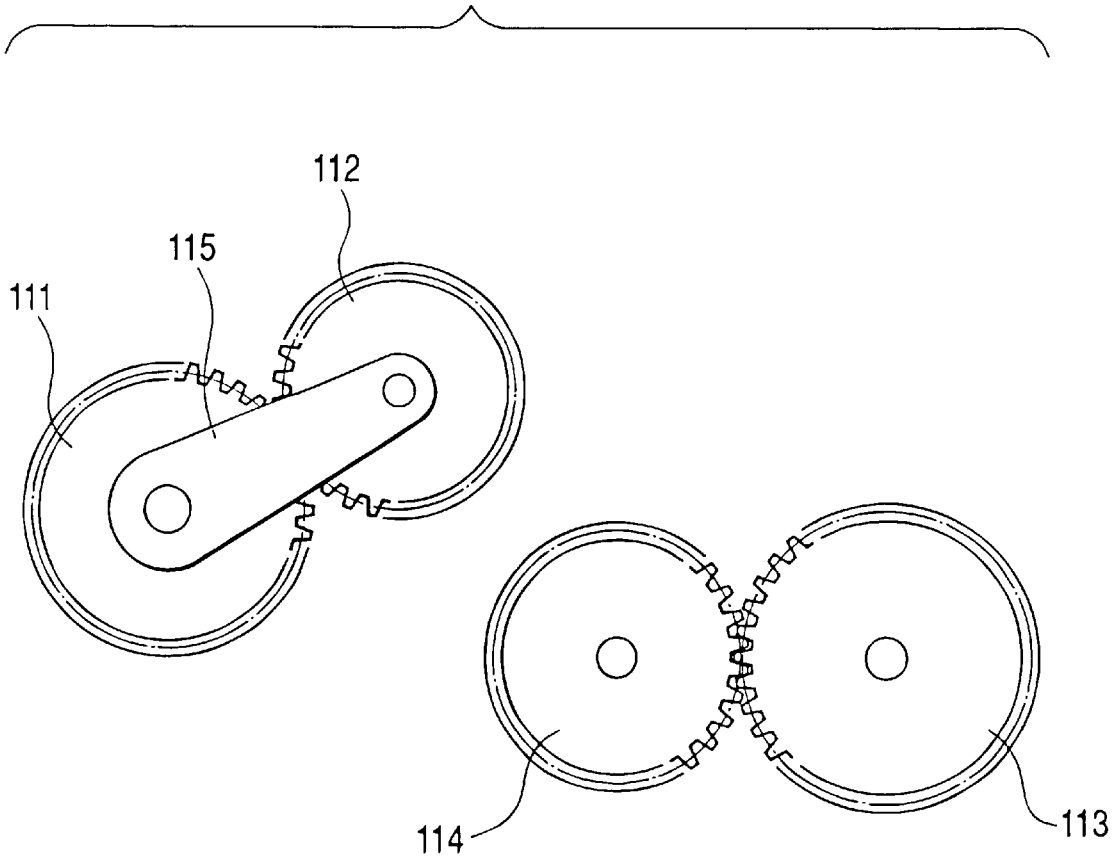
FIG. 8 (PRIOR ART)
FIG. 8 is a plan view showing a schematic configuration of the main part of an ink ribbon advance mechanism in a prior art.

FIG. 1 is a perspective view showing a schematic configuration of the main part of a printer of one embodiment of the invention and FIG. 2 is a perspective view showing the printer with a ribbon cassette mounted in the embodiment of the invention. FIG. 7 is a plan view showing a schematic configuration of the main part of the printer of the embodiment of the invention.

Figure 3:
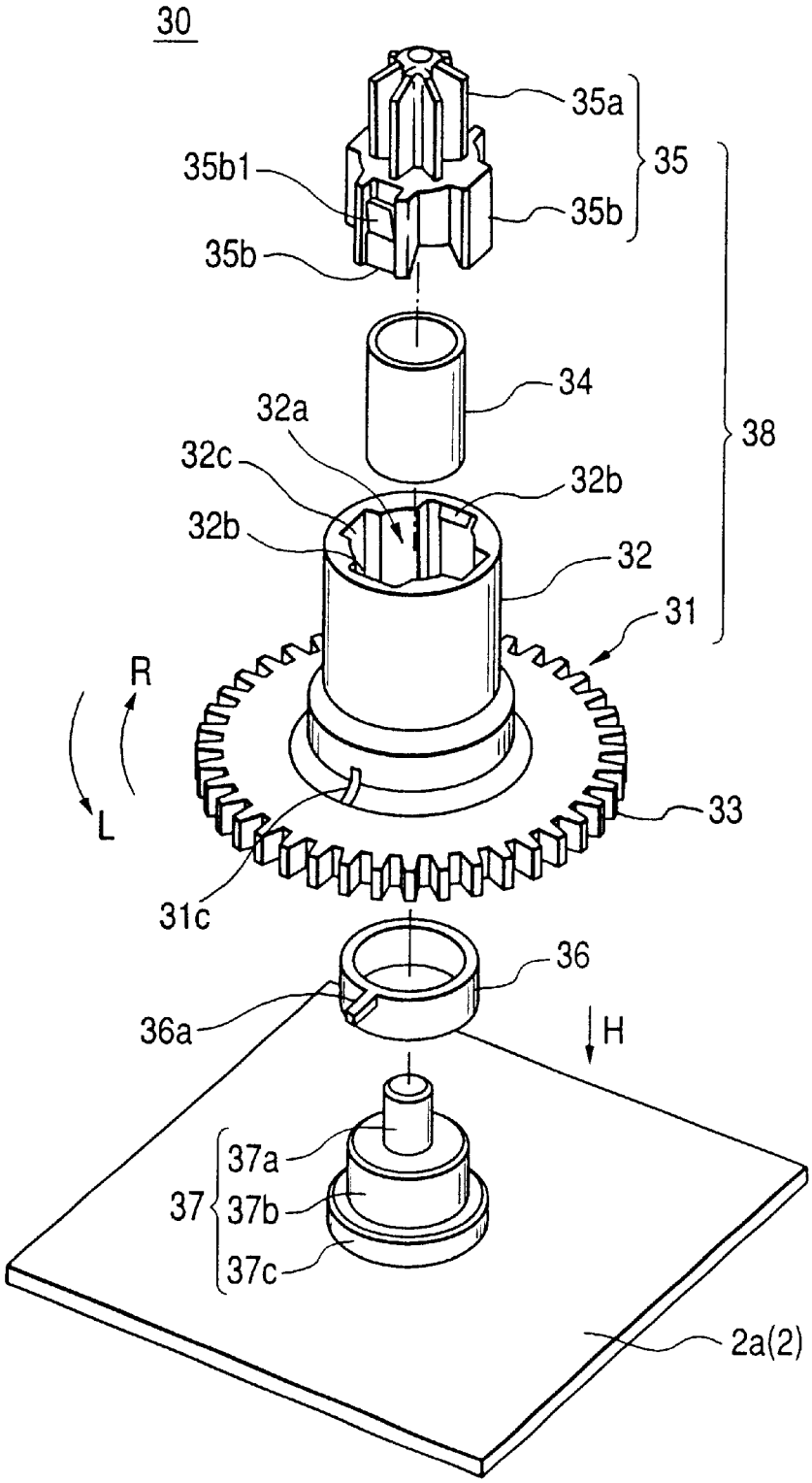
FIG. 3 is an exploded-view drawing showing a schematic configuration of an advance mechanism of the embodiment of the invention.
Figure 4:
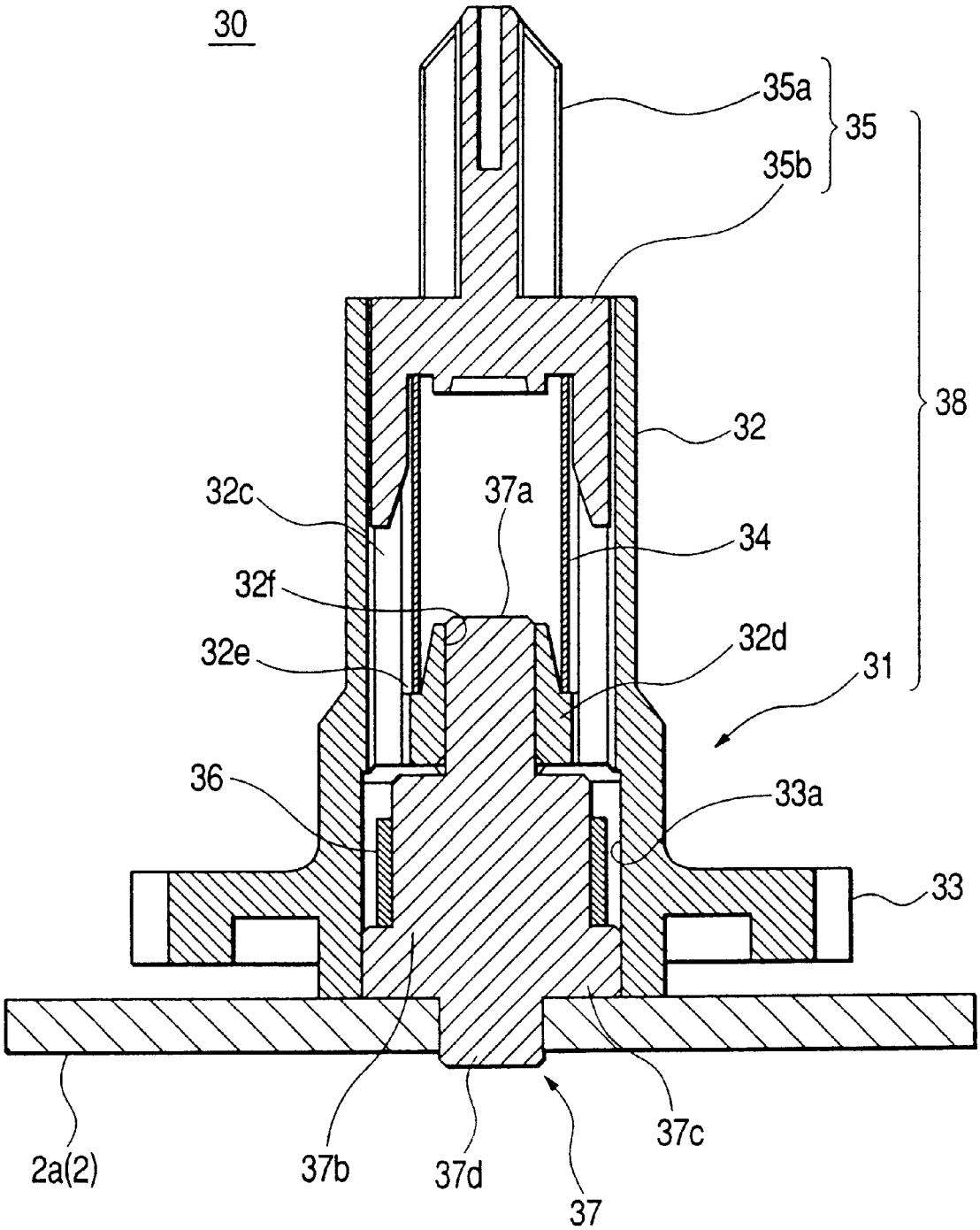
FIG. 4 is a sectional view showing a schematic configuration of the advance mechanism of the embodiment of the invention.
Figure 5:
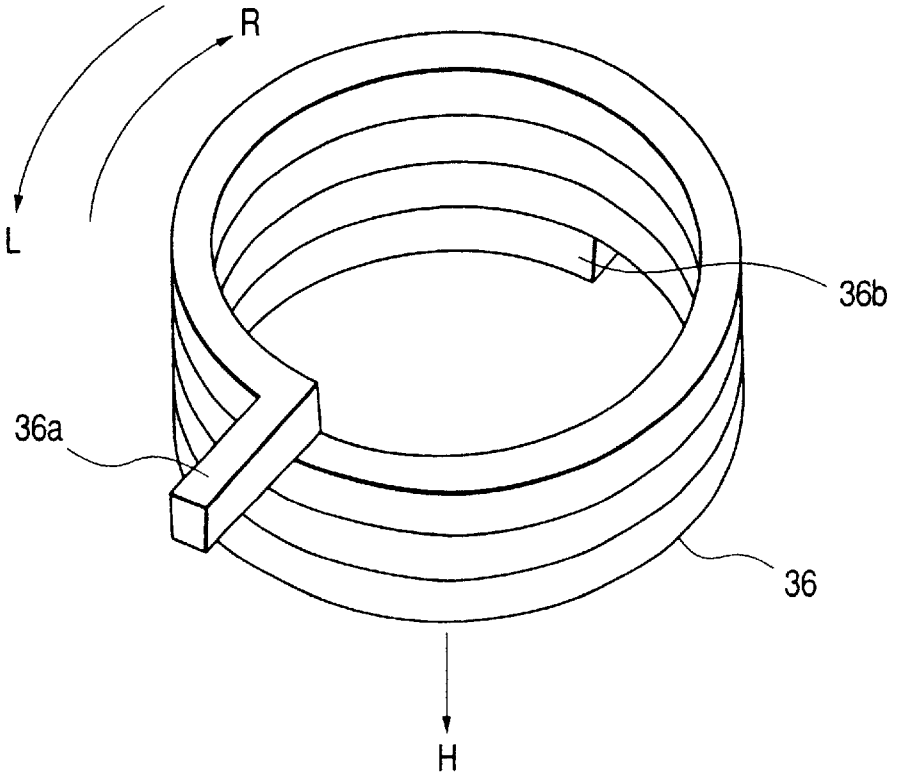
FIG. 5 is a perspective view showing on an enlarged scale the appearance of a coil spring of the advance mechanism of the embodiment of the invention.

FIG. 3 is an exploded-view drawing showing a schematic configuration of an advance mechanism of the embodiment of the invention, FIG. 4 is a sectional view showing a schematic configuration of the advance mechanism of the embodiment of the invention, and FIG. 5 is a perspective view showing on an enlarged scale the appearance of a coil spring of the advance mechanism of the embodiment of the invention.

A printer of the invention can be used in an electronic cash register, a POS system or the like, for example, for printing on roll recording paper, personal check sheets or the like with an ink ribbon by a dot-impact method.

As shown in FIG. 1, the printer 1 of the embodiment has a frame 2 made of metal. The frame 2 is generally made up of a flat rectangular frame base part 2*a,* side parts 2*b* provided perpendicularly to the frame base part 2*a* on both end sides of the frame base part 2*a* in the length direction thereof, and a guide part 2*d* sandwiched between the side parts 2*b* on the rear side of the frame base part 2*a* (top side of FIG. 1). Here, an engagement part 2*b* for engaging a ribbon cassette 50 (described later) projects from each side part 2*b* of the frame 2 on the side towards guide part 2*d.*

A rod-like carriage shaft 3, extending in parallel to the length of the frame base part 2*a,* is attached on the front side of the side parts 2*b* of the frame (bottom side of FIG. 1).

A drive motor 6 for driving an advance mechanism 30 (described later) is provided on the back side of the frame base part 2*a* of the frame 2 (opposite side to the side where the carriage shaft 3 is attached). A drive gear 6*a* is fixed to a drive shaft of the drive motor 6. The drive gear 6*a* is placed close to the carriage shaft 3 in proximity to one side part 2*b* of the frame base part 2*a.*

A rotatable drive pulley 7 operatively associated with the drive gear 6*a* is disposed in proximity to the drive gear 6*a* on the frame base part 2*a*. The drive pulley 7 comprises an integrally molded gear 7*a* and small-diameter pulley 7b concentric with the gear 7*a,* placed so that the gear 7*a* engages with the drive gear 6*a*.

A rotatable driven pulley 9 made up of a gear 9*a* and a small-diameter pulley 9*b* concentric with the gear 9*a* is located in proximity to an opposite side part 2*c* of the frame on the frame base part 2*a*. A drive belt 8 made of an endless toothed belt extends around the pulleys 7*b* and 9*b*. A carriage 5*b* is supported on the carriage shaft 3 and the print head 5 comprising a dot-impact print section 5*a* is mounted on the carriage 5*b*. Here, the carriage 5*b* is fixed to one part of the drive belt 8, so that the carriage 5*b* can be moved in the direction of arrow A or arrow B along the carriage shaft 3. An engagement part 5*c,* extending from the carriage 5*b* on the rear end part side, is engaged with the above-described guide part 2*d,* whereby the print head 5 is kept in a predetermined orientation.

Thus, a carriage drive mechanism 10 of the embodiment consists mainly of the gears 6*a,* 7*a,* and 9*a,* the pulleys 7*b* and 9*b,* and the drive belt 8. A transfer mechanism 20 connected to the carriage drive mechanism 10, for transferring a driving force to the advance mechanism 30 for winding an ink ribbon 51 only when the print head 5 is moved in the arrow A direction, is placed in proximity to the driven pulley 9.

A gear 12 rotatably supported on a support shaft 13 is placed in proximity to a gear 11 engaging with the gear 9*a* of the driven pulley 9. The gear 12 comprises an outer gear 12*a* and a small-diameter inner gear 12*b* integrally molded and concentric with the outer gear 12*a*. The outer gear 12*a* engages with the gear 11.

A flat lever 21 is pivotally supported on the support shaft 13. A support shaft 24 is placed in a part on the lower face side of the lever 21 and a planetary gear 22 is supported on the support shaft 24 so as to engage with the gear 12*b*. A spring member (not shown) is sandwiched between the planetary gear 22 and the lever 21. That is, the planetary gear 22 is rotatably supported on the support shaft 24 while it is given a frictional force by said spring member, with the planetary gear 22 engaging with the gear 12*b*.

A gear 25, comprising an outer gear 25*a* and a small-diameter inner gear 25*b* integrally molded and concentric with the outer gear 25*a,* is rotatably supported on a support shaft 26. The gear 25*b* always engages with a gear 33 of the advance mechanism 30.

The lever 21 comprises a guide groove 21*a* through which the support shaft 26 of the gear 25 passes, and the lever 21 is limited to up and down movement by the support shaft 26 and the guide groove 21*a*. The range in which the lever 21 can be rotated on the support shaft 13 is determined by the length of the guide groove 21*a*. Thus, in the transfer mechanism 20 of the embodiment, the planetary gear 22 and the gear 25*a* are engaged or disengaged each other as the lever 21 is rotated.

As shown in FIG. 2, the ribbon cassette 50 storing an ink ribbon 51 is mounted on the frame 2. The ribbon cassette 50 has a cassette main body 50*a* shaped like a rectangular parallelepiped made of a plastic, for example, and is provided with narrow arm parts 50*b* and 50*c* at both ends of the cassette main body 50.

The ink ribbon 51 made of an endless fabric is placed in the ribbon cassette 50. The ink ribbon 51, which is stored in the cassette main body 50*a,* passes through the arm parts 50*b* and 50*c* and is exposed between an exit and an entrance. The cassette main body 50*a* contains a winding roller (not shown) for winding and circulating the ink ribbon 51. The winding roller is molded integrally with a knob 52 and when the cassette 50*a* is removed from the printer, the ink ribbon can be wound by picking up and turning the knob 52. A hole for engaging a connection part 35 placed at the tip of a winding spool 38 of the advance mechanism 30 is made in the end of the winding roller opposite to the knob 52 (back side of the cassette main body 50*a*). The connection part 35 engages the hole, whereby a driving force can be transferred to the winding roller.

In the printer 1 of this embodiment, the driving force of the drive motor 6 is transferred via the drive pulley 7 and the drive belt 8, so that the print head 5 reciprocates in the arrow A or B direction along the carriage shaft 3.

If the print head 5 is moved in the arrow A direction, the gear 12 is rotated counterclockwise (in FIG. 2, FIG. 7), attempting to rotate the planetary. gear 22 clockwise. However, the planetary gear 22 does not rotate relative to the support shaft 24 because of the frictional load of the spring member sandwiched between the planetary gear 22 and the lever 21. Thus, the lever 21 is pivoted counterclockwise by the gear 12 on the support shaft 13, namely, in the arrow E direction.

At this time, the lever 21 is guided by the support shaft 26 of the gear 25*a* inserted into the guide groove 21*a* made in the lever 21 and is rotated in the arrow E direction to the position at which the planetary gear 22 engages with the gear 25*a*. When the gear 12 is rotated counterclockwise after the position at which the planetary gear 22 is reached to engage with the gear 25*a,* the planetary gear 22 is rotated clockwise on the support shaft 13 in spite of the frictional force with the lever 21, and transfers the driving force to the gear 25*a* engaging the planetary gear 22. Thus, the gear 25*b* formed integrally on the same axis as the gear 25*a* is rotated counterclockwise. A winding spool base part 31 of the advance mechanism 30 is rotated clockwise (in the arrow R direction) via the spool gear part 33 which always engages with the gear 25*b*.

When the print head 5 moved in the arrow A direction is turned around and is moved in the arrow B direction, the gear 12 and the like are rotated in the opposite direction to that described above and the lever 21 is rotated on the support shaft 13 clockwise (in the arrow F direction), causing the planetary gear 22 and the gear 25*a* to be placed out of engagement. At this time, the lever 21 is guided by the support shaft 26 of the gear 25*a* inserted into the guide groove 21*a* made in the lever 21 and is rotated in the arrow F direction until the support shaft 26 abuts one end of the guide groove 21*a*.

Thus, in this embodiment, the driving force of the drive motor 6 is transferred through the transfer mechanism 20 to the advance mechanism 30 only when the print head 5 is moved in the arrow A direction, whereby the ink ribbon 51 in the ribbon cassette 50 is moved in the arrow D direction in FIG. 2 and is wound by a winding roller (not shown).

As shown in FIG. 3, the advance mechanism 30 comprises a support shaft 37 fixed to the frame base part 2*a,* the winding spool 38 rotatably supported on the support shaft 37, and a coil spring 36 (first coil spring) attached to the support shaft 37 for allowing the winding spool 38 to be rotated only in the winding direction. The winding spool 38 comprises the base part 31 and a connection part 35, which is attached to the top of the base part 31 and connected to the ink ribbon for transferring a driving force. As described later, the connection part 35 is attached to the base part 31 so that it can be moved in a parallel direction to the support shaft 37 with respect to the base part 31.

A hole with a spline (key groove) on the inner periphery is located in the bottom of the winding roller contained in the ribbon cassette 50 (in the figure, opposite side to the formation side of the knob 52). The connection part 35 of the winding spool 38 is made of a plastic, for example, and is formed at the tip with a spline 35*a* shaping complementary to the spline formed on the bottom face of the winding roller. A plurality of ribs 35*b* is formed below the spline 35*a* along a direction parallel to the shaft of the winding spool 38 and a claw 35*b*1 projects on a part of the surface of each of the ribs 35*b*.

As shown in FIG. 3 or 4, the base part 31 of the winding spool 38 consists of a cylindrical portion 32 and a gear 33 formed at one end of the cylindrical portion 32, and is formed integrally so that the center of the cylindrical portion 32 matches the shaft of the gear 33.

The upper end of the cylindrical portion 32 has an opening 32*a* at which the connection part 35 is attached. The cylindrical portion 32 is formed on an inner wall with a guide groove 32*c* for guiding the ribs 35*b* of the connection part 35, whereby it is possible to move the connection part 35 axially with respect to the cylindrical portion 32.

The guide groove 32*c* is formed with a claw 32*b* which is caught in the claw 35*b*1 of the connection part 35. Thus, if the connection part 35 moves upward after it is inserted into the inside of the cylindrical portion 32, the claw 35*b*1 of the connection part 35 is caught in the claw 32*b* of the cylindrical portion 32, so that the connection part 35 is prevented from being detached from the base part 31.

A bearing 32*d* having a shaft hole 32*f* fitted to a tip part 37*a* of a support shaft 37 (described later) is formed integrally almost at the center of the inside of the cylindrical portion 32. In the cylindrical portion 32, a compression coil spring 34 (second coil spring) is inserted into the upper side of the bearing 32*d*. The connection part 35 is urged to the opening side of the cylindrical portion 32 by the elastic force of the coil spring 34. As shown in FIG. 4, an annular groove 32*e* is formed in the outer part of the bearing 32*d* and one end of the coil spring 34 is fixed to the groove 32*e*.

Thus, the connection part 35 connected to the ink ribbon 50 is attached to the base part 31 of the winding spool 38 so that it can be moved up and down, and is urged upward by the coil spring 34. When the ribbon cassette 50 is mounted, if the spline of the hole made in the bottom of the winding roller of the ribbon cassette 50 side does not match the spline of the connection part 35, the connection part 35 is moved to the base part 31 side.

That is, when an unfavorable force is applied to the tip of the winding spool 38, the tip (connection part 35) is allowed to escape, so that the tip of the winding member can be prevented from being broken.

A space 33*a* for housing the coil spring 36 attached to the support shaft 37 is provided below the bearing 32*d*. As shown in FIG. 3, a slit 31*c* for retaining the coil spring 36 is formed in the boundary between the cylindrical portion 32 of the winding spool base part 31 and the spool gear part 33.

As shown in FIG. 4, the support shaft 37 is a metal shaft with four, integrally formed steps. A part having a smaller diameter than the center part 37*b* (tip part 37*a*) is formed on one end part side of a center part 37*b* of the support shaft 37 to which the coil spring 36 is fitted. A base part 37*c* having a larger diameter is formed on an opposite end part side of a center part 37*b* of the support shaft 37. The base part 37*c* is formed with a tenon 37*d* of a smaller diameter than that of the base part 37*c* and the tenon 37*d* is caulked to the frame base part 2, whereby the support shaft 37 is fixed.

When the tip part 37a of the support shaft 37 is inserted into the shaft hole 32 of the, bearing 32*d* of the winding spool 38, the inner wall of the opening made in the gear 33 side of the winding spool base part 31 is also supported by the base part 37*c* of the support shaft 37. That is, the winding spool 38 is supported by the tip part 37*a* and the base part 37*c* of the support shaft 37, so that the winding spool 38 can be rotated relative to the support shaft 37 without being inclined to the support shaft 37.

In this embodiment of advance mechanism 30, the coil spring 36 (first coil spring) is placed between the winding spool 38 and the support shaft 37 so as to allow the winding spool 38 to be rotated only in the winding direction.

As shown in FIG. 5, the coil spring 36 is a torsion spring preferably made of a square material, resistant to wear (for example, a kind of piano wire), and is provided at one end with a short linear hook 36*a*.

In this embodiment, the coil spring 36 is formed by winding the square material more than once clockwise (downward in the arrow R direction shown in FIG. 5) with the hook 36*a* as the starting point. The inner diameter of the coil spring 36 is little smaller than the outer diameter of the center part 37*b* of the support shaft 37. The hook 36*a* of the coil spring 36 has a thickness a little larger than the slit 31*c* made in the winding spool base part 31.

The coil spring 36 is attached to the outer peripheral surface of the center part 37*b* of the support shaft 37 in a state in which it is slightly spread. In this state, the center part 37*b* of the support shaft 37 is tightened a small amount by the coil spring 36. On the other hand, the hook 36*a* of the coil spring 36 is fixed to the slit 31*c* in the winding spool base part 31 described above, for example, by press fitting. The space 33*a* into which the coil spring 36 is inserted is enclosed by the cylindrical portion 32 and the base part 37*c* of the support shaft 37, whereby paper powder, dust, and the like, are prevented from entering the proximity of the coil spring 36.

In the advance mechanism 30 having the described configuration, if the winding spool 38 receives a rotational force in the arrow R direction shown in FIG. 3, the force in the arrow R direction from the winding spool base part 31 is applied to the coil spring 36, and causes the diameter of the coil spring 36 to widen. Therefore, a force tightening the center part 37*b* of the support shaft 37 by the coil spring 36 is decreased, thus the coil spring 36 slides on the outer peripheral surface of the center part 37*b* of the support shaft 37. Consequently, the winding spool 38 is rotated in the arrow R direction in FIG. 3 together with the coil spring 36. As described above, in the embodiment, when the print head 5 is moved in the arrow A direction in FIG. 1, the advance mechanism 30 winds the ink ribbon 51.

In this case, a force to shift the coil spring 36 downward (in the arrow H direction) acts on the coil spring 36 along the outer peripheral surface of the center part 37*b* of the support shaft 37 because of the winding direction of the coil spring 36. However, since the part of the end part 36*b* side of the coil spring 36 is in contact with a step between the base part 37*c* and the center part 37*b*, if the coil spring 36 is rotated relative to the support shaft 37, it is not shifted in position.

On the other hand, when the print head 5 is moved in the arrow B direction in FIG. 1, the transfer mechanism 20 shuts off transfer of a driving force to the advance mechanism 30, thus a force rotating the winding spool 38 in the arrow L direction shown in FIG. 3 acts on the winding spool 38 by the restoring force of the arms 50*b* and 50*c* of the ribbon cassette 50 and the tension of the ink ribbon 51.

When such a force acts on the winding spool 38, the force causes the diameter of the coil spring 36 to narrow, thus the coil spring 36 tightens the center part 37*b* of the support shaft 37. Here, since the support shaft 37 is fixed to the frame base part 2*a,* the coil spring 36 does not rotate in the arrow L direction and, therefore, the winding spool 38 does not rotate either. Consequently, the arms 50*b* and 50*c* of the ribbon cassette 50 are kept in a bent state and the ink ribbon 51 is kept in a tightened state.

When the print head 5 is moved in the arrow A direction again with printing and winding the ink ribbon 51, the operation of winding ribbon is started at the above-described state, i.e. the arms 50*b* and 50*c* of the ribbon cassette 50 is in a bent state and the ink ribbon 51 is a tightened state.

According to this embodiment, winding the ink ribbon 51 can always be started at the state in which the ink ribbon 51 is tightened, even to wind the ink ribbon 51 intermittently, so that the winding time of the ink ribbon 51 can be shortened and the print head 5 does not require extra movement, thus the print time can also be shortened. Since the print head 5 needs only minimum movement, this embodiment is particularly effective for executing so-called logical seek printing.

According to this embodiment, when the print head 5 is moved in a direction which does not wind the ink ribbon, the ink ribbon 51 is not slack, so that smudging of recording paper and the like caused by contact with the ink ribbon 51 and catching the print head 5 in the ink ribbon 51 can be prevented.

Further, according to the embodiment, the coil spring 36 is placed in an enclosed space and is protected from paper powder, dust, and the like, caused by recording paper and the like so that a printer having excellent durability can be provided.

In the above-described embodiment, the torsion spring made of a square material is used as the coil spring, but the invention is not limited to a spring having that shape; a torsion spring made of a round material can also be used in response to the requirement of wear resistance characteristic.

The invention is not limited to the above-described embodiment and various modifications can be made.

Figure 6:
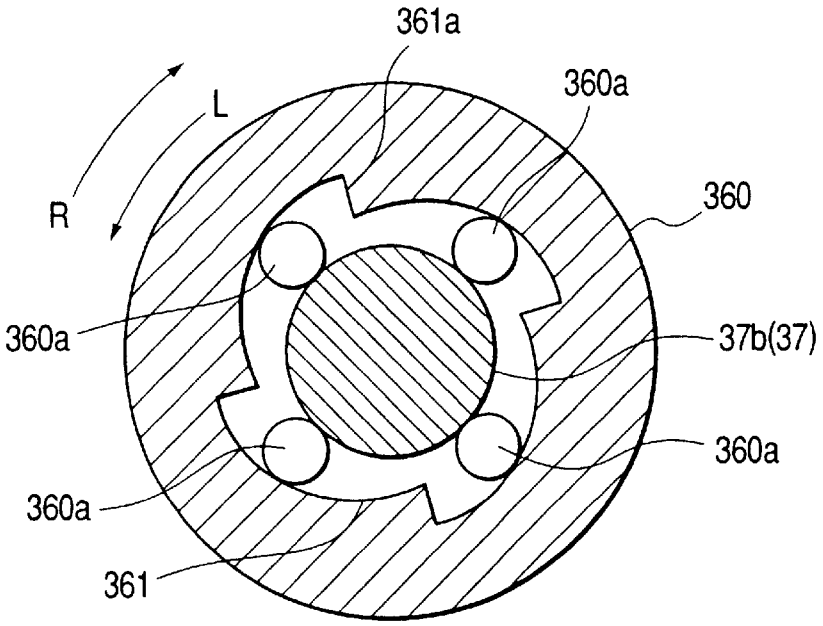
FIG. 6 is a schematic sectional view showing an example of an alternative rotation limitation means for the advance mechanism.

For example, in the above-described embodiment, the coil spring 36 is used as the rotation limiter for allowing Ad rotation only in the winding direction, but the invention is not limited to those means; for example, a winding spool 360 as shown in FIG. 6 can-also be used.

The winding spool 360 is formed on a base part with the rotation limiter-described below in place of the winding spool 38 formed in the space 33*a* as shown in FIG. 3, 4 for allowing the winding spool 38 to be rotated only in one direction. Parts having the functions identical with those in the abovedescribed embodiment are denoted by the same reference numerals in FIG. 6.

FIG. 6 shows the cross section of the lower side of the cylindrical portion of the winding spool of the embodiment. As shown in that figure, the winding spool 360 is formed with a hollow core 361 which cross section is delineated by axially linear and curved lines in combination. A center part 37*b* of a support shaft 37 passes through the hollow core 361. Balls 360*a* are placed in clearances between the support shaft 37*b* and an inner wall of the hollow core 361.

When the winding spool 360 is rotated in the arrow R direction with respect to the support shaft 37, balls 360*a* also are moved in the arrow R direction and abut an inner wall 361*a* of the hollow 361. If the winding spool 38 is rotated, balls 360*a* are held at the position. In this state, the balls 360*a* can be rotated about the support shaft 37 or the winding spool 360, thus the winding spool 360 can also be rotated with respect to the support shaft 37.

On the other hand, when the winding spool 360 is rotated in the arrow L direction with respect to the support shaft 37, the balls 360*a* also are moved in the arrow L direction. As shown in the figure, the clearances into which the balls 360*a* are inserted is formed so that it becomes narrower in the arrow L direction, thus the contact pressure applied to the balls 360*a* is increased, making it impossible for the balls 360*a* to rotate about to the support shaft 37 or the winding spool 360, and rotation of the winding spool 360 in the L direction is locked.

That is, the winding spool 360 of the example is allowed to rotate only in the winding direction (arrow R direction) by the rotation limiter and rotation in the opposite direction to the winding direction (arrow L direction) is suppressed.

What is claimed is:

1. A printer comprising:

a dot-impact head for striking an ink ribbon for printing on recording paper;

a carnage mounting said dot-impact head thereon;

a motor;

a carriage drive mechanism connected to said motor for reciprocating said carriage by turning said motor forward and in reverse;

an advance mechanism for advancing the ink ribbon; and a transfer mechanism connected to said carriage drive mechanism, said transfer mechanism transferring a driving force of said motor to said advance mechanism when said carriage is moved in a first direction and releasing the driving force of said motor from said advance mechanism when said carriage is moved in a second direction opposite to the first direction, wherein said advance mechanism includes:

a support shaft;

a winding spool rotatably supported on said support shaft, said winding spool advancing the ink ribbon by rotating in a third direction said winding spool having a cylindrical housing; and a rotation limiter mounted in an internal space in the cylindrical housing of the winding spool, said rotation limiter allowing the winding spool to rotate in the third direction and inhibiting the winding spool from rotating in a fourth direction opposite to the third direction.

2. The printer as claimed in claim 1 wherein said transfer mechanism further comprises:

a first gear connected to said carriage drive mechanism;

a first gear shaft rotatably supporting the first gear;

a lever pivotally supported on the first gear shaft and having an arc shaped guide groove centered on the first gear shaft;

a second gear connected to said advance mechanism;

a second gear shaft rotatably supporting the second gear and engaging the guide groove for guiding the pivotal movement of the lever;

a third gear shaft provided on the lever; and a third gear rotatably attached to the third gear shaft and engageable with the second gear, and wherein the lever is adapted to move in a direction in which the third gear engages with the second gear when said carriage is moved in the first direction, and move in a direction in which the third gear disengages from the second gear.

3. The printer as claimed in claim 2 wherein the rotation limiter further comprises a first coil spring wound around the support shaft and having one end fixed to the winding spool, and wherein the first coil spring is deformably attached to the support shaft so that the first coil spring tightens on the support shaft when the winding spool is rotated in the fourth direction, and is loosened from the shaft when the winding spool is rotated in the third direction.

4. The printer as claimed in claim 3 wherein the support shaft has a base part below a portion where the first coil spring is attached, said base part having a larger diameter than said portion, and wherein the winding spool has an opening with approximately the same diameter as the base part, and wherein the first coil spring is accommodated in said internal space which is defined by the winding spool and the base part of the support shaft.

5. The printer as claimed in claim 3 wherein the winding spool further comprises;

a fourth gear connected to said transfer mechanism, a base part having a bearing for receiving the support shaft, a connection part connected to a ribbon cassette for transferring a driving force to the ribbon cassette, said connection part attached to the base part so as to be moveable in a direction parallel to the support shaft, and wherein a second coil spring is disposed in the base part for urging the connection part in a direction away from the base part.

6. The printer as claimed in claim 5 wherein an annular groove for fixing one end of the second coil spring is formed in an outer part of the bearing.

7. The printer as claimed in claim 1 wherein the rotation limiter further comprises a first coil spring wound around the support shaft and having one end fixed to the winding spool, and the first coil spring is deformably attached to the support shaft so that the first coil spring tightens on the support shaft when the winding spool is rotated in the fourth direction, and is loosened from the shaft when the winding spool is rotated in the third direction.

8. The printer as claimed in claim 7 wherein below a portion where the first coil spring is attached, the support shaft comprises a base part having a larger diameter than the portion, wherein the winding spool has an opening with approximately the same diameter as the diameter of the base part, and wherein the first coil spring is accommodated in said internal space which is defined by the winding spool and the base part of the support shaft.

9. The printer as claimed in claim 7, wherein the winding spool further comprises;

a fourth gear connected to said transfer mechanism, a base part having a bearing for receiving the support shaft, a connection part connected to a ribbon cassette for transferring a driving force to the ribbon cassette, said connection part attached to the base part and so as to be moveable in a direction parallel to the support shaft, and wherein a second coil spring is disposed in the base part for urging the connection part in a direction away from the base part.

10. The printer as claimed in claim 9 wherein an annular groove for fixing one end of the second coil spring is formed in an outer part of the bearing.

11. The printer as claimed in claim 1 wherein the winding spool further comprises a fourth gear connected to said transfer mechanism, a base part having a bearing for receiving the support shaft, and a connection part connected to a ribbon cassette for transferring a driving force to the ribbon cassette, and wherein the connection part is attached to the base part so that it can be moved in a direction parallel to the support shaft, and wherein a second coil spring is disposed in the base part for urging the connection part in a direction away from the base part.

12. The printer as claimed in claim 11 wherein an annular groove for fixing one end of the second coil spring is formed in an outer section of the bearing.

13. A printer comprising:

a print head with at least one element for striking an ink ribbon for printing on recording paper;

a carriage mounting said print head thereon;

a rotary motor;

a carriage drive mechanism connected to said motor for reciprocating said carriage by rotating said motor forward and in reverse;

an advance mechanism for advancing the ink ribbon, said advance mechanism having a cylindrical housing and a rotation limiter mounted in an internal space in the cylindrical housing of the advance mechanism and allowing the advance mechanism to rotate in one direction and inhibiting the advance mechanism from rotating in the opposite direction; and a transfer mechanism connected to said carriage drive mechanism, said transfer mechanism transferring a driving force of said motor to said advance mechanism when said carriage is moved in a first direction and releasing the driving force of said motor from said advance mechanism when said carriage is moved in a second direction opposite to the first direction.

14. The printer as claimed in claim 13 wherein the advance mechanism comprises a winding spool rotatable in a third direction to advance the ink ribbon, and wherein the rotation limiter further comprises:

a support shaft, a first coil spring wound around the support shaft and having one end fixed to the winding spool, the first coil spring is deformably attached to the support shaft so that the first coil spring tightens on the support shaft when the winding spool is rotated in a fourth direction opposite from the third direction, and is loosened from the shaft when the winding spool is rotated in the third direction, and wherein the support shaft comprises a base part below a portion where the first coil spring is attached, said base part having a larger diameter than said portion, the winding spool having an opening with approximately the same diameter as the diameter of the base part, and the first coil spring is accommodated in said internal space which is defined by the winding spool and the base part of the support shaft.

15. The printer as claimed in claim 14 wherein said transfer mechanism further comprises:

a first gear connected to said carriage drive mechanism;

a first gear shaft rotatably supporting the first gear;

a lever pivotally supported on the first gear shaft and having an arc shaped guide groove centered on the first gear shaft;

a second gear connected to said advance mechanism;

a second gear shaft rotatably supporting the second gear and engaging the guide groove for guiding the pivotal movement of the lever;

a third gear shaft provided on the lever; and a third gear rotatably attached to the third gear shaft and engageable with the second gear, wherein the lever is adapted to move in a direction in which the third gear engages with the second gear when said carriage is moved in the first direction, and move in a direction in which the third gear disengages from the second gear.

16. The printer as claimed in claim 15 wherein the rotation limiter further comprises a first coil spring wound around the support shaft and having one end fixed to the winding spool, wherein the first coil spring is deformably attached to the support shaft so that the first coil spring tightens on the support shaft when the winding spool is rotated in the fourth direction, and is loosened from the shaft when the winding spool is rotated in the third direction;

the transfer mechanism further comprising:

a fourth gear connected to said transfer mechanism;

the base part having a bearing for receiving the support shaft;

a connection part connected to a ribbon cassette for transferring a driving force to the ribbon cassette, said connection part attached to the base part so as to be moveable in a direction parallel to the support shaft; and a second coil spring disposed in the base part for urging the connection part in a direction away from the base part.

17. A printer comprising:

a carriage mounting a print head thereon;

a rotary motor coupled with a carriage drive mechanism, said rotary motor operating in forward and reverse directions for reciprocating said carriage;

an advance mechanism for advancing an ink ribbon, said advance mechanism having a cylindrical housing and a rotation limiter mounted in an internal space in the cylindrical housing of the advance mechanism, the rotation limiter allowing the advance mechanism to rotate in one direction and inhibiting the advance mechanism from rotating in the opposite direction; and a transfer mechanism connected to said carriage drive mechanism, said transfer mechanism transferring a driving force of said rotary motor to said advance mechanism when said rotary motor is moved in one of said forward and reverse directions and releasing the driving force of said rotary motor from said advance mechanism when said carriage is moved in the other of said forward and reverse directions.

* * * * *

UNITED STATES PATENT AND TRADEMARK OFFICE

CERTIFICATE OF CORRECTION

PATENT NO. : 6,478,486 B1
DATED : November 12, 2002
INVENTOR(S) : Ando

It is certified that error appears in the above-identified patent and that said Letters Patent is hereby corrected as shown below:

Title page,
Insert Item -- [30] Foreign Application Priority Data
January 7, 1999 [JP] P. Hei. 11-001987. --

Item [63], delete
" [63] Continuation of application No. PCT/JP99/07383, filed on Dec. 28, 1999."
and insert therefor
-- [63] Continuation of application No. PCT/JP99/07383, filed on Dec. 27, 1999. --

Signed and Sealed this

Eighth Day of July, 2003

JAMES E. ROGAN
*Director of the United States Patent and Trademark Office*